US008215274B2

(12) United States Patent
Rozario et al.

(10) Patent No.: US 8,215,274 B2
(45) Date of Patent: Jul. 10, 2012

(54) HYDRAULIC CONTROL SYSTEM FOR ENGINE CAM PHASING

(75) Inventors: Frederick J. Rozario, Fenton, MI (US); Joseph E. Robbins, Mayville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1057 days.

(21) Appl. No.: 12/141,564

(22) Filed: Jun. 18, 2008

(65) Prior Publication Data

US 2009/0314235 A1 Dec. 24, 2009

(51) Int. Cl.
*F01L 1/34* (2006.01)

(52) U.S. Cl. ..... 123/90.17; 123/90.12

(58) Field of Classification Search ..... 123/90.15, 123/90.17, 90.38, 90.12, 90.6, 193.1, 90.13, 123/193.3; 74/567, 568 R
See application file for complete search history.

(56) References Cited

U.S. PATENT DOCUMENTS

| | | | | |
|---|---|---|---|---|
| 5,718,196 | A * | 2/1998 | Uchiyama et al. | 123/195 C |
| 6,247,436 | B1 * | 6/2001 | Lancefield et al. | 123/90.38 |
| 6,722,330 | B2 * | 4/2004 | Pierik et al. | 123/90.17 |
| 6,810,866 | B2 | 11/2004 | Geiser | |
| 7,270,096 | B2 * | 9/2007 | Lancefield et al. | 123/90.17 |
| 7,284,517 | B2 * | 10/2007 | Lancefield et al. | 123/90.17 |

FOREIGN PATENT DOCUMENTS

| | | |
|---|---|---|
| EP | 1 473 443 A2 | 11/2004 |
| JP | 10008987 A | 1/1998 |

* cited by examiner

*Primary Examiner* — Thomas Denion
*Assistant Examiner* — Daniel Bernstein
(74) *Attorney, Agent, or Firm* — Quinn Law Group, PLLC

(57) ABSTRACT

A hydraulic control system to provide an oil or pressurized fluid supply to a variable cam phasing system in an engine is provided. The hydraulic control system includes a valve housing attachable to a front cover assembly of the engine; a first valve installed in the housing; and an inlet passage defined by the front cover assembly hydraulically communicating with the first valve in the housing to carry pressurized fluid from a fluid source to the first valve. A first and a second outlet passage defined by the housing hydraulically communicates with the first valve to allow the pressurized fluid to flow to the cam phasing system, thereby variably moving a camshaft assembly operatively connected to the cam phasing system.

12 Claims, 4 Drawing Sheets

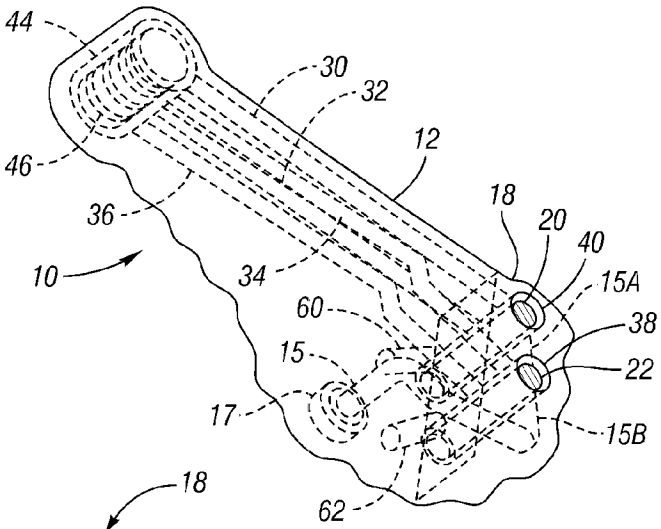
FIG. 2
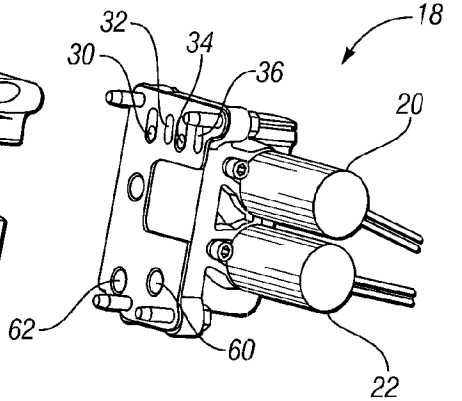
FIG. 1B
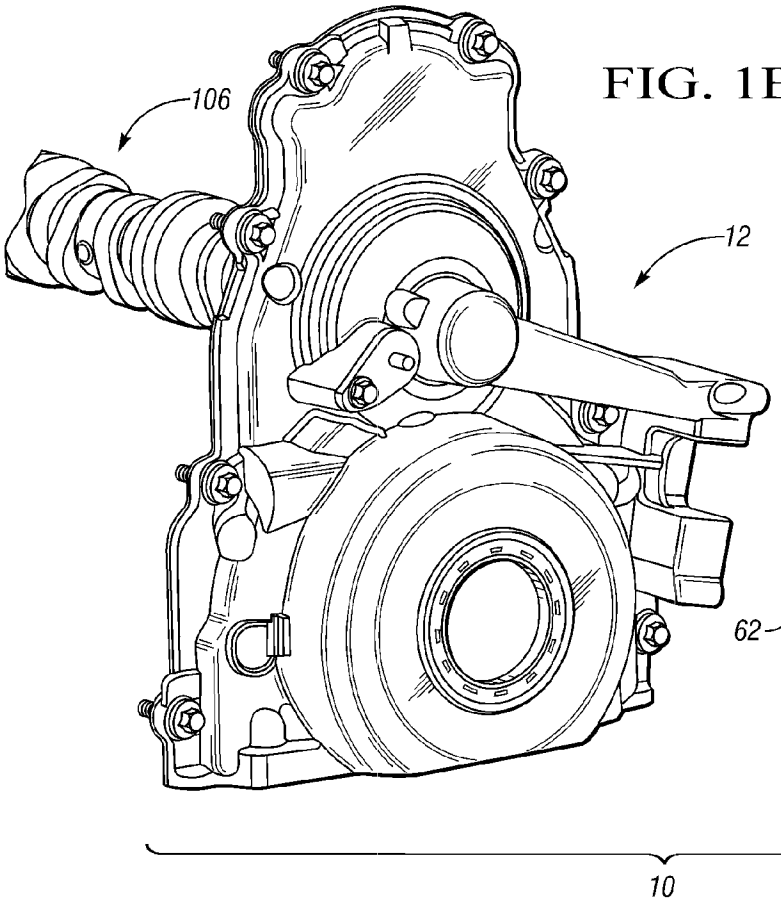

HYDRAULIC CONTROL SYSTEM FOR ENGINE CAM PHASING

TECHNICAL FIELD

The invention relates to a hydraulic control system for providing an oil or pressurized fluid supply to a variable cam phasing system in an engine.

BACKGROUND OF THE INVENTION

In engines having one or more cylinders with dual camshafts, one for actuating the engine intake valves and a second camshaft for actuating the engine exhaust valves, a cam phaser on one or both of the camshafts may be provided for adjusting within predetermined ranges the angular positions or phases of the camshafts relative to the engine crankshaft. A single cam phaser may be mounted on the exhaust camshaft of the engine or a dual cam phasing system, with independent cam phasers on the exhaust camshaft and intake camshaft respectively, may be used.

A dual independent cam phasing system allows for variable overlap of intake and exhaust valve events and hence has improved power, torque and smoothness of operation of the engine. A control system, such as a hydraulic control system, enables the operation of a dual independent cam phasing system.

SUMMARY OF THE INVENTION

The invention relates to an apparatus (i.e. a hydraulic control system) for providing an oil or pressurized fluid supply to a variable cam phasing or timing system in an engine, especially an overhead valve engine. The apparatus includes a valve housing attachable to a front cover assembly of the engine. Alternatively, the valve housing may be integrally formed with the front cover assembly as a unitary component. A first valve is installed in the valve housing (i.e. in a first valve bore defined by the valve housing). The housing has an inlet passage hydraulically communicating with the first valve to carry pressurized fluid from a fluid source to the first valve. In one aspect of the invention, the front cover assembly has a first and a second outlet passage hydraulically communicating with the first valve to allow the pressurized fluid to flow to a cam phasing system operatively connected to the first and the second outlet passages, thereby variably moving a camshaft assembly operatively connected to the cam phasing system.

In another aspect of the invention, the pressurized fluid is oil provided from within a cylinder block of the engine. In another aspect of the invention, the first valve is a solenoid valve which is movable to control the flow of the pressurized fluid.

In another aspect of the invention, a generally tubular insert has a first groove and is attachable to the front cover assembly. A fluid communication device, also referred to as a spigot, is placed within the insert such that it is rotatable within the insert. The spigot has a first and a second longitudinal hole. The first longitudinal hole hydraulically connects the first outlet passage to the cam phasing system. The first groove and the second longitudinal hole hydraulically connect the second outlet passage to the phasing system. The second longitudinal hole is plugged at an outer end of the spigot.

An apparatus to transfer fluid from a plurality of passages in a stationary element to a rotating element without intermixing the fluid in each passage is also provided. The apparatus includes a generally tubular insert attachable to the stationary element and a rotatable fluid distribution device, also referred to as a spigot, placed within the insert sufficiently to allow for rotation of the spigot. The spigot is attachable to the rotating element and has a first longitudinal hole within it to operatively connect a first passage to the rotating element. The insert defines a first groove that is connected to a second longitudinal hole in the spigot through a first opening in the spigot. The first groove in the insert and the second longitudinal hole in the spigot operatively connect a second passage to the rotating element.

In another aspect of the invention, a plurality of seals is placed around the spigot to separate the fluid flow to or from the first and the second longitudinal holes.

In another aspect of the invention, the front cover assembly also defines a first tank port passage in hydraulic communication with the first valve to drain away residual fluid from the first valve bore. The first tank port passage drains out of the front cover assembly to a space defined between the front cover assembly and the cylinder block. In another aspect of the invention, the valve housing defines a first bore for installation of the first valve. The first bore hydraulically communicates with the first valve and with the first and the second outlet passages. By providing a separately attachable valve housing, machining complex bores that require plugging of multiple portions may be avoided; thus ease of manufacture is realized.

In another aspect of the invention, a second valve is installed in the valve housing. The second valve is a solenoid valve which is movable to control the flow of the pressurized fluid. The inlet passage hydraulically communicates with the second valve in the housing, to carry the pressurized fluid from the fluid source to the second valve.

In another aspect of the invention, the front cover assembly has a third and a fourth outlet passage that hydraulically communicate with the second valve to sufficiently channel the pressurized fluid to the cam phasing system. The cam phasing system is operatively connected to the third and the fourth outlet passages. The valve housing defines a second bore for installation of the second valve. The second bore hydraulically communicates with the second valve and with the third and the fourth outlet passage. In another aspect of the invention, the front cover assembly has a second tank port passage hydraulically communicating with the second valve to drain away residual fluid from the second valve bore.

In another aspect of the invention, a second groove in the insert and a third longitudinal hole in the spigot operatively connect the third outlet passage to the cam phasing system. A third groove in the insert and a fourth longitudinal hole in the spigot operatively connect the fourth outlet passage to the cam phasing system. The third and the fourth longitudinal holes are plugged at the outer end of the spigot. The first, second, and third grooves connect to the second, third and fourth longitudinal holes, respectively, through first, second and third openings on the surface of the spigot.

In another aspect of the invention, the cam phasing system includes an intake cam phaser and an exhaust cam phaser. The cam phasing system includes a front vane plate integrally formed with a plurality of exhaust vanes, a rear vane plate integrally formed with a plurality of intake vanes, and a middle housing having a plurality of cavities that engage with the intake and the exhaust vanes. The intake and the exhaust vanes each have a first and a second side. The intake and the exhaust vanes are rotatable in a clockwise and a counterclockwise direction with respect to the middle housing through pressure of the pressurized fluid exerted on the first and the second sides of the respective intake and the exhaust vanes.

In another aspect of the invention, the first valve is operatively connected to and delivers fluid pressure to both the first and second sides of the intake vanes; and the second valve is operatively connected to and delivers fluid pressure to both the first and second sides of the exhaust vanes.

In another aspect of the invention, the movement of the first and the second valve modulates the pressure on the intake and the exhaust vanes of the cam phasing system, causing the intake and the exhaust vanes to rotate, thereby variably moving a camshaft assembly operatively connected to the cam phasing system. A method of supplying pressurized fluid to a hydraulic control system of a variable cam phasing system in an engine is also provided.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 1B is a schematic perspective exploded view of the valve housing and front cover assembly of FIG. 2;

FIG. 2 is a fragmentary perspective view of the valve housing attached to the front cover assembly shown in FIGS. 1A and 1B;

DESCRIPTION OF THE PREFERRED EMBODIMENTS

Figure 1A:
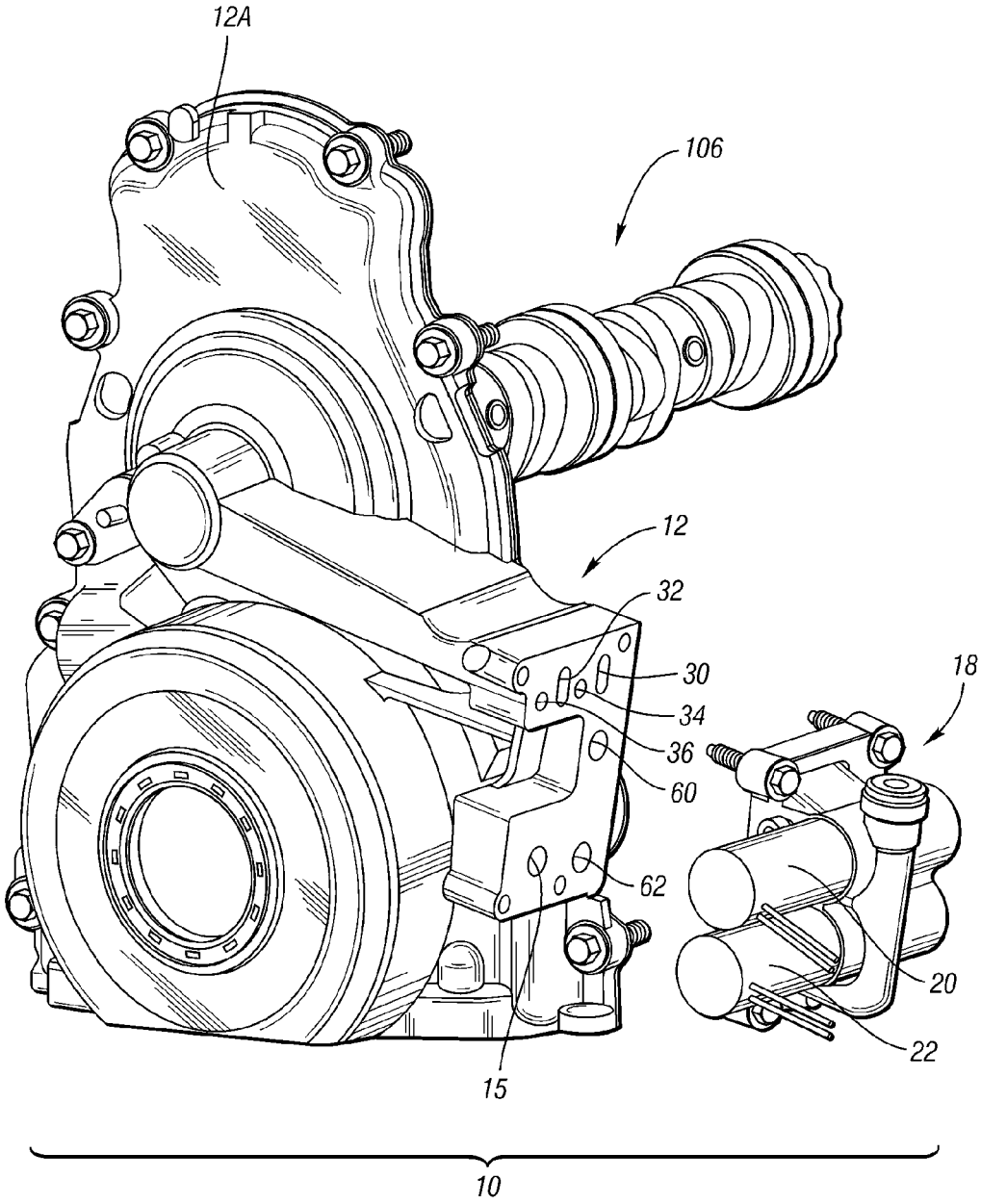
FIG. 1A is a schematic perspective exploded view of a valve housing attachable to an engine front cover assembly, in accordance with a preferred embodiment of the invention.

FIGS. 1A and 1B are partial front perspective views of an apparatus 10, also referred to as a hydraulic control system, to provide an oil supply to a variable cam phasing or timing system in an overhead valve engine, in accordance with a preferred embodiment of the invention. The apparatus 10 as described below may also be used to enable several types of variable cam timing systems in overhead valve engines such as intake-only, exhaust-only and dual-equal cam phasing, as well as dual-independent cam phasing. The apparatus 10 can be used in a non-overhead valve engine as well.

Figure 3:
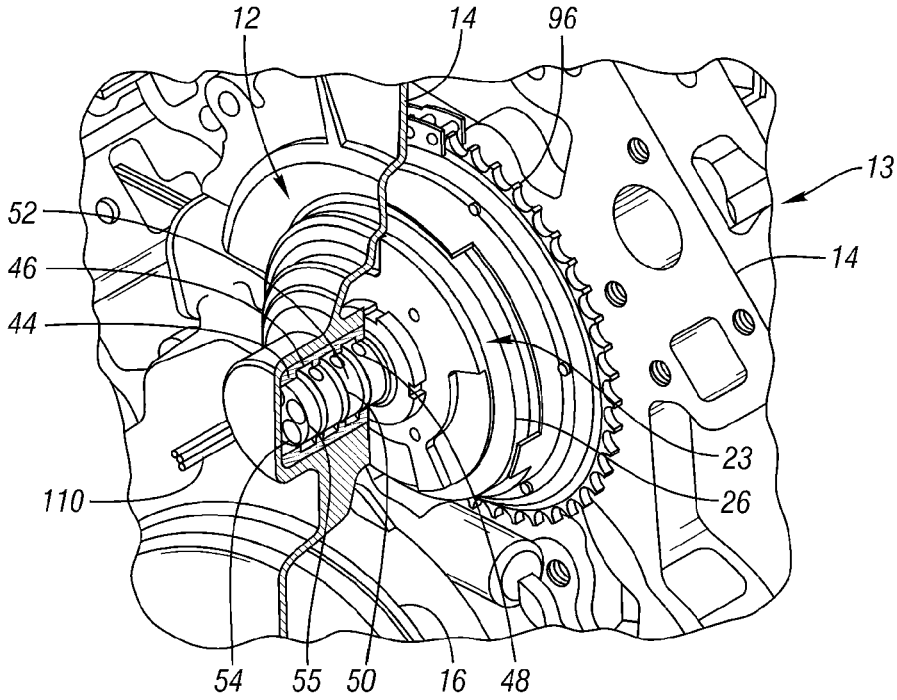
FIG. 3 is a schematic fragmentary front perspective view of the engine front cover assembly shown in FIGS. 1A and 1B, partially cut-away to show the components behind the engine front cover assembly.
Figure 4:
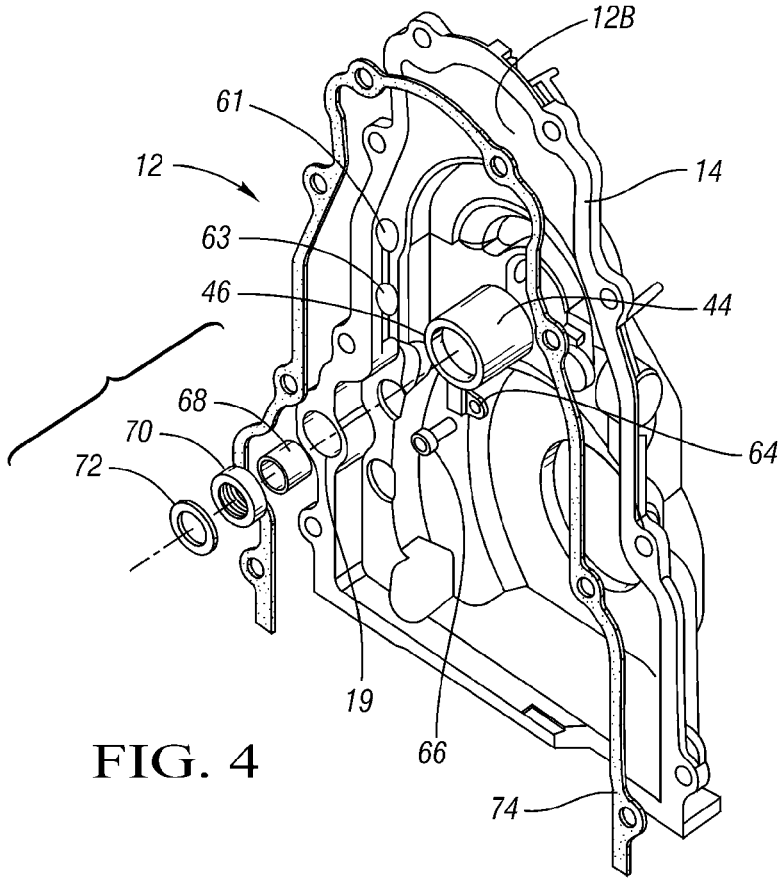
FIG. 4 is a partially exploded schematic perspective rear view of the engine front cover assembly shown in FIG. 1A.

FIG. 2 is a partial perspective view of the apparatus shown in FIGS. 1A and 1B, with the valve housing 18 attached to the front cover assembly 12. In all figures, like reference numbers refer to like items. FIG. 3 is a partial front perspective view of an engine front cover assembly 12 also shown in FIGS. 1A and 1B, partially cut-away to show the components behind the engine front cover assembly 12. FIG. 4 is a partially exploded perspective rear view of the engine front cover assembly 12 shown in FIGS. 1A and 1B.

The engine front cover assembly 12 (shown in FIG. 1A, FIG. 1B, FIG. 3, and FIG. 4) generally fits over the front end of an engine 13 (see FIG. 3), in front of a cylinder block 14 (see FIG. 3) of the engine 13. An inlet passage 15, shown in FIG. 1A, FIG. 1B and FIG. 2, in the engine front cover assembly 12 carries pressurized fluid from a fluid source to a separate valve housing 18 which is fastened or otherwise attached to the side of the engine front cover assembly 12. In the preferred embodiment, the pressurized fluid is oil and an oil supply is provided from the main gallery (not shown) of the cylinder block 14 (see FIG. 3). Oil pressure and flow is generated by the engine oil pump 16 (see FIG. 3), which is driven by the crankshaft (not shown) directly.

The inlet passage 15 includes a portion 17, shown in FIG. 2. As shown in the rear perspective view of the engine front cover assembly 12 in FIG. 4, the inlet passage 15 of FIG. 1A, FIG. 1B and FIG. 2 exits the rear face 12B of the engine front cover assembly 12 at orifice 19. The orifice 19 further connects with the front face of the cylinder block 14 (shown in FIG. 3). Alternatively, a pressurized fluid other than oil may be used, in which case a fluid source or pump of pressurized fluid would be attached at portion 17 of the inlet passage 15.

Two oil control valves are installed in the valve housing 18. As shown in FIGS. 1A and 1B, a first valve 20 and a second valve 22 are installed in respective valve bores 40, 38 formed by or machined in the valve housing 18 (valves 20 and 22 shown in fragmentary cross-sectional view in FIG. 2 within the bores 40, 38). In the preferred embodiment, the first and the second valve 20, 22 are solenoid valves which move between different positions to control the flow of oil to a cam phasing system 23 of FIG. 3. The inlet passage 15 provides an oil feed to both valves 20, 22, with an inlet passage portion 15A (see FIG. 2) providing oil to the first valve 20 and an inlet passage portion 15B (see FIG. 2) providing oil to the second valve 22.

Valve Housing

In the preferred embodiment, the front cover assembly 12 and the valve housing 18 each define different portions of four outlet oil passages, different pairs of which are in fluid communication with the first and the second valves 20, 22, respectively, (thus making a total of four oil passages 30, 32, 34, 36), to channel oil pressure and flow to a cam phasing system 23 of FIG. 3. Suitable types of fasteners (shown in FIGS. 1A and 1B) may be used to attach the first and the second valve 20, 22 to the valve housing 18, and plug(s) may be used to seal or close off the outlet oil passages 30, 32, 34, 36.

Multiple variations in the number of solenoid valves and oil passages may be made within the scope of the invention. For example, in an intake-only or exhaust-only cam phasing system, there may be one solenoid valve with one inlet passage and two outlet passages connected to the solenoid valve.

The control valve housing 18 may be made integrally as part of the front cover assembly 12, or may be formed as a separate housing that fastens onto the front cover assembly 12. As described above, the control valve housing 18 includes the inlet passage portions 15A, 15B to channel oil from the main gallery of the cylinder block 14 (see FIG. 3) to each first and second valve 20, 22 via inlet passage 15.

In the preferred embodiment, the valve housing 18 is a unitary component, with a plurality of bores drilled or formed in the valve housing 18 for the installation of the first and second valves 20, 22 and for each passage going through the valve housing 18. Alternatively, the first and second valves 20, 22 may be mechanically attached to the valve housing 18 rather than inserted in bores formed therein. As shown in FIG. 2, first and second bores 40 and 38 are formed in the valve housing 18 for installation of the first and second valves 20, 22, respectively. The first bore 40 provides hydraulic communication between the first valve 20 and the first and the second outlet passages 30, 32. The second bore 38 provides hydraulic communication between the second valve 22 and the third and the fourth outlet passages 34, 36.

Figure 6:
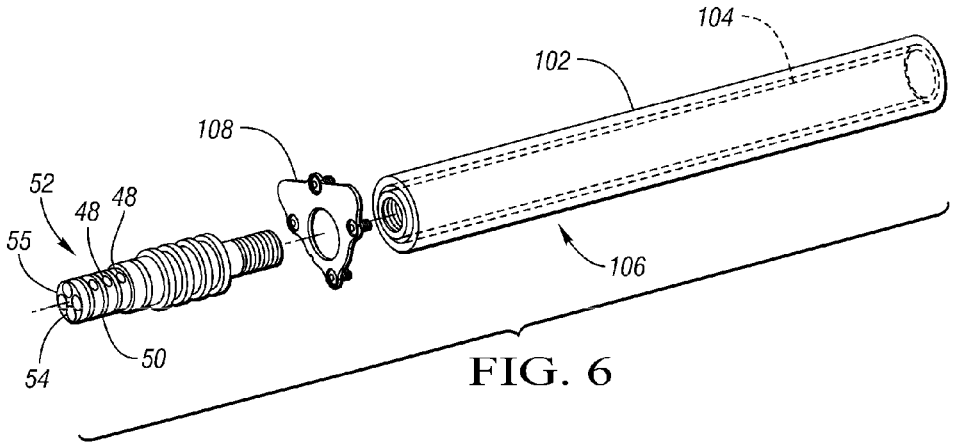
FIG. 6 is a partially exploded perspective view of a concentric camshaft assembly operatively connected to the valve housing and front cover assembly of FIG. 1A through FIG. 4.

The front cover assembly 12 includes a generally cylindrical annular tubular section, referred to here as an insert 44 (see FIGS. 2-3) and a fluid distribution device, referred to herein as a spigot 52 (see FIGS. 3, 6) to fluidly connect the four outlet oil passages 30, 32, 34, 36 to the cam phaser assembly 23. The spigot 52 rotates within the internal diameter of the insert 44 (oil feed) with a small controlled clearance therebetween. The spigot 52 includes four longitudinal holes shown at 54. Note that FIG. 2 shows the insert 44 only and not the spigot 52. FIGS. 3 and 6 show the spigot 52.

Four separate channels are formed for each of the four outlet oil passages 30, 32, 34, 36. One outlet oil passage (passage 30 in the preferred embodiment) connects to one of the four longitudinal holes 54 that is open at the outer end 55 of the spigot 52 (see FIGS. 3, 6). The other three longitudinal holes 54 are plugged at the outer end 55 (plugs not shown). The three outlet oil passages 32, 34, 36 connect to three grooves 46 formed in the insert 44 (see FIG. 2). The profile of the grooves 46 is shown in FIG. 3 in the cut-away portion.

The three grooves 46 connect to the three longitudinal holes 54 that are plugged at the outer end 55 through three separate openings 48 (see FIGS. 3, 6) on the surface of the spigot 52. As best shown in FIG. 3, a plurality of seals 50 (four in the preferred embodiment) help to keep separate four channels or routes formed for each of the outlet oil passages 30, 32, 34, 36 (see FIG. 1A) between the insert 44 and the spigot 52. Thus, the spigot 52 acts as an oil distribution or communication device enabling high volume of oil flow. Alternatively, a series of channels can be integrally formed or machined in the camshaft itself. Variations in the number of grooves, channels and holes may be made within the scope of the invention.

The front cover assembly 12 forms a plurality of tank port passages 60, 62 (see FIGS. 1-2) that are in fluid communication with and serve as tank ports for the first and second valves 20, 22, respectively, and provide a quick response to drain away residual or excess oil as the first and second valves 20, 22 are cycled from one position to another. The tank port passages 60, 62 pass through or connect to holes or perforations 61 and 63 (see FIG. 4) that are made in the front cover assembly 12. This allows the tank port passages 60, 62 to drain into the space behind the rear face 12B of the front cover assembly 12, i.e., the space between the front cover assembly 12 and the front of the cylinder block 14 (see FIG. 3), which in turn communicates with the crankcase or oil pan (not shown).

As seen in FIG. 4, the front cover assembly 12 further includes a retainer or locking tab 64 and fastener 66 to retain insert 44 to the front cover assembly 12. A screen 68 may be provided for the oil supply to prevent foreign material from entering the first and second valves 20, 22 and their corresponding cam phasers 76, 78 (see FIG. 5), and interfering with their operation. A retainer 70 is provided to keep the screen 68 in place. The front cover assembly 12 further includes an oil seal 72 to prevent leakage of oil. A seal (not shown) may also be used for the front of the crankshaft (not shown). In the preferred embodiment, the oil seal is molded as part of a front cover gasket 74; however, alternatively, a 17.2 mm by 2 mm O-ring may be used for the oil seal. The gasket 74 is provided to prevent leakage from the front cover assembly 12.

Cam Phasing System

Figure 5:
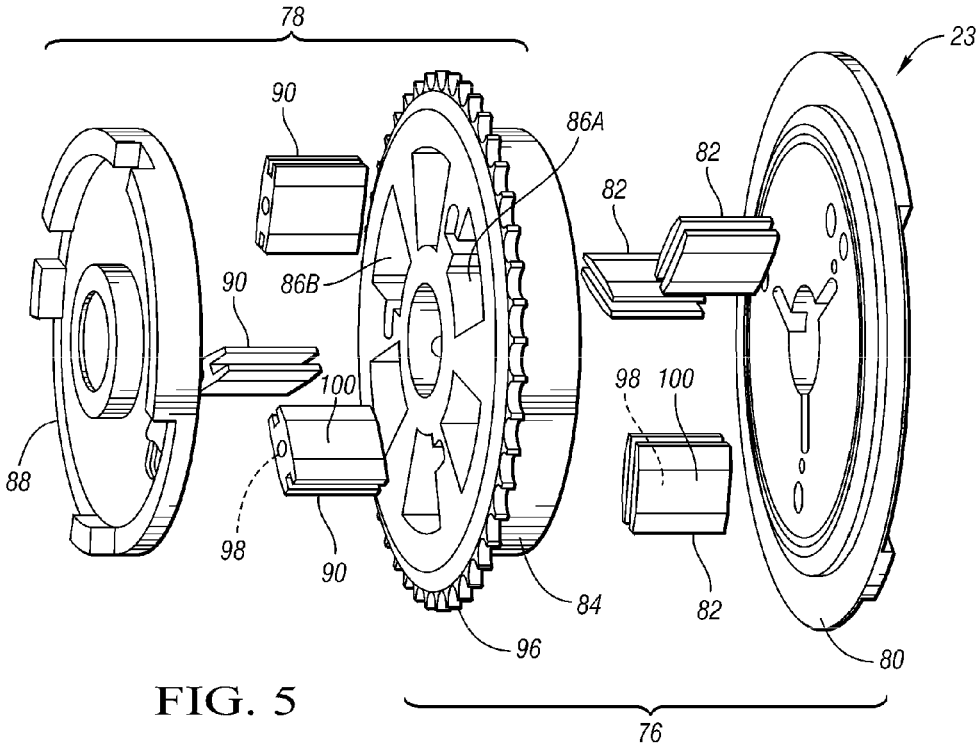
FIG. 5 is a partially exploded schematic perspective view of a cam phasing system operatively connected to the valve housing and front cover assembly of FIG. 1A through FIG. 4.

The first and the second valve 20, 22 are operatively connected to a cam phasing system 23 (see FIGS. 3 and 5). The cam phaser assembly 23 includes an intake cam phaser 76 and an exhaust cam phaser 78. FIG. 5 is a partially exploded perspective view of the cam phasing system 23. The first and the second valves 20, 22 control oil flow to the intake cam phaser 76 and exhaust cam phaser 78, in such a manner as to advance or retard a corresponding camshaft that is operatively connected to the cam phasing system 23, as explained below.

The intake and exhaust cam phasers 76, 78 may be integrated into a single housing or they may be housed separately, however they operate independently of each other. In the preferred embodiment, the intake cam phaser 76 includes a rear vane plate 80 with intake vanes 82 integrally formed or attached to the rear vane plate 80, and a middle housing 84 having cavities 86A, as shown in FIG. 5. The intake vanes 82 fit into the cavities 86A with a sufficient clearance to allow for rotation of the intake vanes 82.

The exhaust cam phaser 78 includes a front vane plate 88 with exhaust vanes 90 integrally formed or attached to the front vane plate 88, and the middle housing 84 having cavities 86B. The exhaust vanes 90 fit into the cavities 86B with a sufficient clearance to allow for rotation of the exhaust vanes 90. Generally, the middle housing 84 includes three cavities 86A to engage with three intake vanes 82 and three cavities 86B to engage with exhaust vanes 90, respectively. The middle housing 84 also includes sprocket teeth 96 that are driven by a crankshaft (not shown) through a cam drive chain (not shown).

The intake vanes 82 and exhaust vanes 90 may be rotated with respect to the middle housing 84 in both a clockwise and a counter-clockwise direction, through oil pressure exerted on either the first side 98 or second side 100 of each respective vane. In order to provide a source of oil pressure exerted on the first side and second side of a vane, two of the four outlet passages 30, 32, 34, 36 each are designated to operatively connect with the intake and exhaust cam phasers 76, 78. The rotation of the plurality of vanes of the cam phasing system 23 modulates the position of an intake camshaft 102 and an exhaust camshaft 104 that are operatively connected to the cam phasing system 23.

Thus, the first valve 20 is operatively connected to and delivers a fluid signal or fluid pressure to both the first and second sides 98, 100 of the intake vanes 82 in the intake cam phaser 76. Likewise, the second valve 22 is operatively connected to and delivers a fluid signal or fluid pressure to both the first and second sides 98, 100 of the exhaust vanes 90 in the exhaust cam phaser 78.

The intake cam phaser 76 and the exhaust cam phaser 78 are connected to the intake camshaft 102 and an exhaust camshaft 104, respectively. FIG. 6 shows a partial or fragmentary exploded perspective view of a concentric camshaft assembly 106, wherein like reference numbers refer to like items. As shown in FIG. 6, the intake and exhaust camshafts 102, 104 are nested one within another in the concentric camshaft assembly 106 in the preferred embodiment (shown also in FIGS. 1A, 1B). FIG. 6 also shows the spigot 52 (as described above) and a connecting thrust plate 108. The cam lobes and other components of the concentric camshaft assembly 106 are not shown in the partial or fragmentary view of FIG. 6 (shown in FIGS. 1A, 1B). The intake and exhaust camshafts 102, 104 may be phased independently of each other and also with respect to the crankshaft (not shown). Alternative variations of the camshaft assembly 106 may also be employed.

In summary, pressurized oil is transferred from a stationary front cover assembly 12 into a rotating spigot 52 that is attached to the cam phasing system 23 and the concentric camshaft assembly 106. Further, depending on the oil pressure exerted on either the first side 98 or second side 100 of a respective vane 82, 90, the vanes can be made to rotate in clockwise or counter-clockwise directions with respect to the middle housing 84 to modulate the positions (advancing and retarding) of the intake and exhaust camshafts 102, 104 and the crankshaft (not shown), which is fixed together in phase through a cam drive chain (not shown).

Electronic Control System

The engine control module (ECM) (not shown) sends a pulse-width modulated (PWM) signal which controls the movement of the first and the second valves 20, 22. The engine control module is electronically linked to the first and the second valves 20, 22. As noted above, the movement of the first and the second valves 20, 22 modulates the position of the concentric camshaft assembly 106 with respect to the crankshaft (not shown), which is operatively connected to the concentric camshaft assembly 106 through a cam drive chain (not shown). This is done through fluid pressure on both the first and second sides 98, 100 of the intake and exhaust vanes 82, 90 in the intake cam phaser 76 and the exhaust cam phaser 78, respectively.

The engine control module (ECM) continuously monitors the position of the crankshaft, comparing it to target values from a pre-determined table and computing deviations from the target values. Oil flow is modulated in order to provide a constant correction from the target values. Thus, a feedback loop is set up, enabling the modulation of oil flow in order to keep the deviation of the crankshaft and cam phasing system position from the desired target position to a minimum. Alternative suitable valves and control systems may also be used.

In summary, the first and the second valves 20, 22 are pulse-width-modulated by an electronic control system which provides closed-loop or feedback control of camshaft angular position, with respect to the crankshaft. An exhaust cam position sensor 110 (see FIG. 3) and/or an intake cam position sensor (not shown) may both be installed in the front cover assembly 12 to provide position information to the engine control module (ECM).

Alternatively, the exhaust cam position sensor 110 may be installed in the front cover and the intake cam position sensor may be installed in the lifter oil manifold assembly (not shown), or other engine structure, in order to "read" the pattern formed as part of the rear plate of the cam phasing system 23. In order to detect the angular position of a camshaft, the system may utilize a "tone" wheel, with a toothed form that can be "read" by a camshaft position sensor and decoded by the electronic control system so as to provide continuous angular position feedback. These toothed wheels are integrated into or formed as part of the front and rear vane plates. Alternative suitable connections may also be used.

While the best modes for carrying out the invention have been described in detail, those familiar with the art to which this invention relates will recognize various alternative designs and embodiments for practicing the invention within the scope of the appended claims.

The invention claimed is:

1. A hydraulic control system to supply fluid to a variable cam phasing system in an engine, the hydraulic control system comprising:

a valve housing attached to the front cover assembly of said engine;

a first valve installed in said housing;

wherein said valve housing defines an inlet passage hydraulically communicating with said first valve to carry pressurized fluid to said first valve;

wherein said first valve is a solenoid valve movable to control flow of said pressurized fluid;

wherein said front cover assembly further defines a first and a second outlet passage hydraulically communicating with said first valve and with said cam phasing system;

a generally tubular insert having a first groove and attachable to said front cover assembly;

a fluid distribution device placed within said insert, said fluid distribution device having a first and a second longitudinal hole formed therewithin;

wherein said first longitudinal hole in said fluid distribution device fluidly connects said first outlet passage to said cam phasing system;

wherein said first groove in said insert and said second longitudinal hole in said fluid distribution device fluidly connect said second outlet passage to said cam phasing system wherein said cam phasing system includes:

a front vane plate integrally formed with a plurality of exhaust vanes;

a rear vane plate integrally formed with a plurality of intake vanes;

a middle housing having a plurality of cavities that engage with said intake and said exhaust vanes;

wherein each of said intake and said exhaust vanes has a first and a second side; and wherein said intake and said exhaust vanes are rotatable in a clockwise and a counter-clockwise direction with respect to said middle housing through fluid pressure exerted on said first and said second sides, respectively, of said intake and said exhaust vanes.

2. The hydraulic control system of claim 1, wherein said pressurized fluid is oil routed from a cylinder block of said engine.

3. The hydraulic control system apparatus of claim 1, wherein said valve housing is integrally formed as part of said front cover assembly.

4. The hydraulic control system of claim 1, wherein said second longitudinal hole is plugged at an outer end of said fluid distribution device.

5. The apparatus of claim 4, further comprising:

a plurality of seals placed around said fluid distribution device to separate fluid flow to said first and said second longitudinal holes; and wherein said fluid distribution device is rotatably supported within said generally tubular insert.

6. The apparatus of claim 5, wherein said front cover assembly further defines a first tank port passage in hydraulic communication with said first valve to drain residual fluid through said front cover assembly.

7. The apparatus of claim 6, wherein said valve housing further defines a first bore in which said first valve is installed, wherein said first bore hydraulically communicates with said first valve and said first and said second outlet passages.

8. The apparatus of claim 7, further comprising:

a second valve installed in said valve housing, wherein said second valve is a solenoid valve movable to control the flow of said pressurized fluid; and wherein said inlet passage is in hydraulic communication with said second valve, to carry pressurized fluid to said second valve.

9. The apparatus of claim 8, wherein said front cover assembly further defines a third and fourth outlet passage in hydraulic communication with said second valve and with said cam phasing system to sufficiently channel pressurized fluid to said cam phasing system;

wherein said front cover assembly further defines a second tank port passage hydraulically communicating with said second valve to drain residual fluid;

wherein said valve housing further defines a second bore formed in said housing in which said second valve is installed; and wherein said second bore is in hydraulic communication with said second valve and with said third and said fourth outlet passages.

10. The apparatus of claim 9, wherein said insert further defines a second groove; wherein said fluid distribution device further defines a third longitudinal hole to fluidly connect said third outlet passage to said cam phasing system;

wherein said insert further defines a third groove; wherein said fluid distribution device further defines a fourth longitudinal hole to operatively connect said fourth outlet passage to said cam phasing system;

wherein said third and said fourth longitudinal holes are plugged at an outer end of said fluid distribution device; and wherein said first, said second, and said third grooves connect to said second, said third and said fourth longitudinal holes, respectively, through first, second and third openings on a surface of said fluid communication device.

11. The apparatus of claim 1, further comprising:

a second valve installed in said valve housing, wherein said second valve is a solenoid valve movable to control the flow of said pressurized fluid;

wherein said inlet passage is in hydraulic communication with said second valve, to carry pressurized fluid to said second valve;

wherein said first valve is operatively connected to and exerts fluid pressure on both said first and said second sides of said intake vanes;

wherein said second valve is operatively connected to and exerts fluid pressure on both said first and said second sides of said exhaust vanes; and wherein movement of said first and second valves modulates said pressure on said intake and said exhaust vanes of said cam phasing system, causing said intake and said exhaust vanes to rotate, thereby variably moving a camshaft assembly operatively connected to said cam phasing system.

12. A method of supplying pressurized fluid to a variable cam phasing system in an engine comprising:

installing a first valve in a valve housing attachable to a front cover assembly of said engine;

providing an inlet passage in said front cover assembly to hydraulically communicate with said first valve in said housing to carry pressurized fluid from a fluid source to said first valve;

providing a first and a second outlet passage in said front cover assembly to hydraulically communicate with said first valve to sufficiently channel said pressurized fluid to the cam phasing system; wherein said first valve is a solenoid valve movable to control the flow of pressurized fluid;

draining residual of said pressurized fluid through a first tank port passage defined by said front cover assembly that is in hydraulic communication with said first valve; wherein said first tank port passage drains into a space defined between said front cover assembly and said cylinder block;

providing a first bore in said valve housing for installation of said first valve, wherein said first bore hydraulically communicates with said first valve and said first and said second outlet passages;

wherein said cam phasing system includes:

a front vane plate integrally formed with a plurality of exhaust vanes;

a rear vane plate integrally formed with a plurality of intake vanes;

a middle housing having a plurality of cavities that engage with said intake and said exhaust vanes;

wherein each of said intake and said exhaust vanes has a first and a second side; and wherein said intake and said exhaust vanes are rotatable in a clockwise and a counter-clockwise direction with respect to said middle housing through pressure of said pressurized fluid exerted on said first and said second sides of respective said intake and said exhaust vanes.

* * * * *